US009505214B2

(12) United States Patent
Takahashi

(10) Patent No.: US 9,505,214 B2
(45) Date of Patent: Nov. 29, 2016

(54) LIQUID DISCHARGE HEAD, LIQUID DISCHARGE DEVICE, AND LIQUID DISCHARGE APPARATUS

(71) Applicant: Aki Takahashi, Kanagawa (JP)

(72) Inventor: Aki Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/750,077

(22) Filed: Jun. 25, 2015

(65) Prior Publication Data

US 2015/0375505 A1 Dec. 31, 2015

(30) Foreign Application Priority Data

Jun. 27, 2014 (JP) ..... 2014-133096
Mar. 11, 2015 (JP) ..... 2015-048796

(51) Int. Cl.
*B41J 2/14* (2006.01)
*B41J 2/055* (2006.01)

(52) U.S. Cl.
CPC ..... *B41J 2/14233* (2013.01); *B41J 2/055* (2013.01); *B41J 2002/14419* (2013.01)

(58) Field of Classification Search
CPC ..... B05B 1/14; B41J 2/055; B41J 2/14233; B41J 2/1433; B41J 2002/14419
USPC ..... 347/44
See application file for complete search history.

(56) References Cited

U.S. PATENT DOCUMENTS

2009/0102907 A1* 4/2009 Yamanaka ..... B41J 2/055 347/94
2011/0122199 A1 5/2011 Takemoto et al.
2013/0176365 A1 7/2013 Tajima
2014/0036007 A1 2/2014 Sasaki
2014/0078221 A1 3/2014 Sasaki et al.

FOREIGN PATENT DOCUMENTS

JP 2010-201940 9/2010
JP 2011-110743 6/2011
JP 2013-141773 7/2013
JP 2014-018982 2/2014
JP 2014-030939 2/2014
JP 2014-037123 2/2014

* cited by examiner

*Primary Examiner* — Manish S Shah
*Assistant Examiner* — Roger W Pisha, II
(74) *Attorney, Agent, or Firm* — Cooper & Dunham LLP

(57) ABSTRACT

A liquid discharge head includes a plurality of nozzles to discharge liquid droplets; a plurality of individual liquid chambers to which the plurality of nozzles communicates; a common liquid chamber, to supply a liquid to the plurality of individual liquid chambers, including a wall disposed opposite a side of an individual liquid chamber and formed of a deformable damper; a frame forming the common liquid chamber and a damper chamber disposed opposite the common liquid chamber with the damper in between, in which the frame accommodates a damper member including the damper and includes a concave portion that serves as the damper chamber; and an opening opposite the damper and a support member to support the damper member, in which the opening and the support member is disposed on a bottom of the concave portion facing the common liquid chamber.

20 Claims, 10 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

The present application claims priority pursuant to 35 U.S.C. §119(a) from Japanese patent application numbers 2014-133096 and 2015-048796, filed on Jun. 27, 2014 and Mar. 11, 2015, respectively, the entire disclosure of each of which is incorporated by reference herein.

BACKGROUND

Technical Field

Exemplary embodiments of the present invention relate to a liquid discharge head, a liquid discharge device, and a liquid discharge apparatus.

Background Art

As a liquid discharge apparatus, an inkjet recording apparatus is known that employs a liquid discharging recording method using a recording head formed of a liquid discharge head to discharge liquid droplets.

In the liquid discharge head, compression of individual liquid chambers cause droplets to be discharged and fluctuation of the pressure generated in the individual liquid chambers is propagated as a pressure wave to a common liquid chamber (or a common channel) to supply liquid to the individual liquid chambers. When the pressure wave propagated to the common liquid chamber is inversely propagated to an individual liquid chamber, the pressure in the individual liquid chamber is fluctuated so that a meniscus of a nozzle is not controlled, the liquid droplet is not discharged at a predetermined droplet speed with a predetermined droplet amount (or a droplet volume), thereby causing misfiring of droplets. In addition, when the pressure wave propagated to the common liquid chamber further propagates to an adjacent individual liquid chamber, the propagation causes reciprocal interference to adversely affect the liquid itself, thereby inducing a leak or discharge of liquid droplet from the wrong nozzles and resulting in unstable discharge.

SUMMARY

In one embodiment of the disclosure, there is provided an optimal liquid discharge head including a plurality of nozzles to discharge liquid droplets; a plurality of individual liquid chambers to which the plurality of nozzles communicates; a common liquid chamber, to supply a liquid to the plurality of individual liquid chambers, including a wall disposed opposite a side of an individual liquid chamber and formed of a deformable damper; a frame forming the common liquid chamber and a damper chamber disposed opposite the common liquid chamber with the damper in between, in which the frame accommodates a damper member including the damper and includes a concave portion that serves as the damper chamber; and an opening opposite the damper and a support member to support the damper member, in which the opening and the support member is disposed on a bottom of the concave portion facing the common liquid chamber.

In one embodiment of the disclosure, there is also provided an optimal liquid discharge device including the above-described liquid discharge head, and an optimal liquid discharge apparatus including the above described liquid discharge head or the liquid discharge device.

These and other objects, features, and advantages of the present invention will become apparent upon consideration of the following description of the preferred embodiments of the present invention when taken in conjunction with the accompanying drawings.

DETAILED DESCRIPTION

Figure 1:
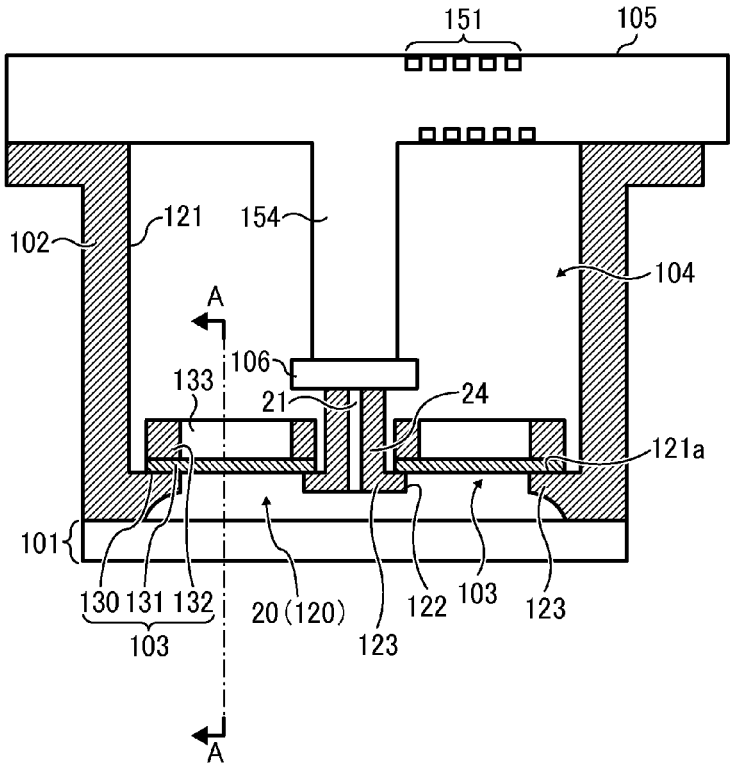
FIG. 1 is a schematic cross-sectional view of a liquid discharge head along a nozzle alignment direction according to a first embodiment of the present invention.
Figure 2:
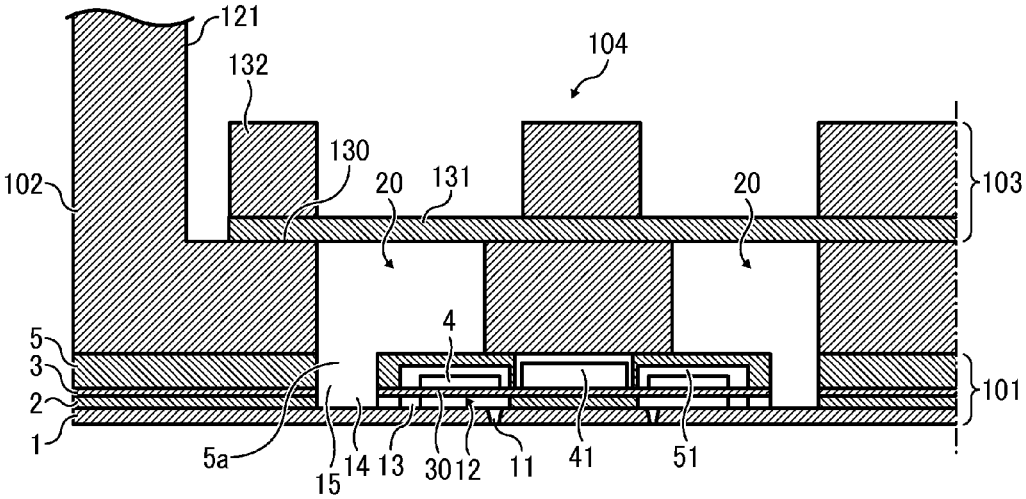
FIG. 2 is an enlarged cross-sectional view of a channel portion of the liquid discharge head along a line A-A in FIG. 1 perpendicular to the nozzle alignment direction.

Hereinafter, preferred embodiments of the present invention will be described with reference to accompanying drawings. FIGS. 1 and 2 each illustrate a liquid discharge head according to a first embodiment of the present invention. Specifically, FIG. 1 is a schematic cross-sectional view of the liquid discharge head along a nozzle alignment direction, and FIG. 2 is an enlarged cross-sectional view of a channel portion of the liquid discharge head along a line A-A in FIG. 1 perpendicular to the nozzle alignment direction.

The liquid discharge head includes a channel member 101 including a pressure generating means and a frame 102 forming the head and supporting the channel member 101.

The channel member 101 is formed of a nozzle plate 1, a channel plate 2, a diaphragm 3, a piezoelectric element 4 as the pressure generating means, and a support substrate 5. The support substrate 5 of the channel member 101 and the frame 102 are joined together. The channel member 101 is integrally formed of the above members as an independent unit, and is laminated to the frame 102 in the present embodiment, but not limited thereto. The pressure generating means is not limited to the piezoelectric actuator, but may be an electrostatic actuator or a thermal actuator.

The nozzle plate 1 is provided with a plurality of nozzles 11 to discharge liquid droplets. Herein, although there are four rows of nozzles, for simplicity only two rows are depicted in FIG. 2.

The channel plate 2 is formed of the nozzle plate 1, the diaphragm 3, an individual liquid chamber 12 to which the nozzle 11 communicates, a fluid resistance member 13 communicating to the individual liquid chamber 12, and a liquid inlet 14 to which the fluid resistance member 13 communicates. The liquid inlet 14 communicates to a common liquid chamber 20 that is formed by the frame 102, via a supply port 15 and a channel 5*a* of the support substrate 5.

The diaphragm 3 is a wall member to form a deformable vibration area or a vibration plate 30 forming a part of the wall of the individual liquid chamber 12. The piezoelectric element 4 is disposed integrally with the vibration plate 30 on a surface opposite the individual liquid chamber 12, the vibration plate 30 and the piezoelectric element 4 form a unimorph piezoelectric actuator. A driver IC 41 to drive each piezoelectric element 4 is disposed between two rows of piezoelectric elements 4. The support substrate 5 includes a concave portion 51 at an area corresponding to the vibration plate 30. The concave portion 51 provides a space protecting the piezoelectric element 4.

Next, each part will be briefly described. The nozzles 11 are formed in the nozzle plate 1 using pressed and polished stainless steel (SUS), but are not limited thereto and alternatively, the nozzles 11 can be formed of nickel plate by electroforming, or from other metals, resins, or laminated member with a resin layer and a metal layer. A water repellent layer is formed on a liquid droplet discharging side of the nozzle plate 1, that is, on a surface of the discharging direction.

The channel plate 2 employs a silicon-on-insulator (SOI) substrate in which silicon is laminated via a silicon oxide film on the silicon substrate, and the silicon oxide film is etched as an etching stop layer. The channel plate 2 further includes grooves and through-holes for constructing the individual liquid chambers 12, the fluid resistance member 13, and the liquid inlet 14. Materials for the channel plate 2 are not limited to the above. Alternatively, the channel plate 2 may be formed of glass other than silicon, inorganic materials such as ceramics, alloys such as SUS, and resins.

As described above, the unimorph piezoelectric actuator is constructed of the piezoelectric element 4 formed on the vibration plate 30 of the diaphragm 3. When the channel plate 2 is formed using the SOI substrate by etching the SOI substrate with the silicon oxide film set as the etching stopper layer, remaining part of silicon oxide film and silicon form the vibration plate 30.

The vibration plate 30 is not limited to one integrally formed with the channel plate 2 by the SOI substrate. Materials for the diaphragm 3 may include, for example, semiconductors, metal oxide, metal nitride, metal carbonate, and the like. Semiconductor materials may include polycrystal silicon (Si), amorphous Si, germanium (Ge), and the like. Examples of metal oxide and metal nitride include silicon (Si) compounds employed in ordinary ceramics, aluminum (Al) compounds, zirconium (Zr) compounds, titanium (Ti) compounds, yttrium (Y) compounds, tantalum (Ta) compounds, tin (Sn) compounds, and indium (In) compounds.

The diaphragm 3 may be a single-layered or multi-layered film. The diaphragm 3 as an etching stopper layer is film-formed for forming the vibration plate 30 on the silicon substrate by gas phase method such as chemical vacuum deposition (CVD) or sputtering, and the silicon substrate is etched to thus form the channel and the vibration plate 30 at the same time.

The piezoelectric element 4 is formed by etching each layer that will be a lower electrode, a piezoelectric layer, and an upper layer from the side of the vibration plate 30.

Preferred materials for the upper electrode and the lower electrode may include Ag, Au, Pt, Ir, Pd, W, and Ta, each of which has a high melting point.

In addition, preferred materials for an interface layer between the upper electrode and the piezoelectric layer and the lower electrode and the piezoelectric layer include materials having high heat resistance and chemical stability not apt to be mutually diffused with the electrode member to prevent interdiffusion. For example, the metal oxide, metal nitride, and metal carbonate can be used. Further, complex compound of the above materials can be used. In addition, the interface layer may include a function as an electrode by using certain conductive compounds.

Preferred materials for forming the piezoelectric layer include publicly known materials. As one of the preferred piezoelectric materials, lead zirconium titanate (LZT) is recommended because of a high piezoelectric constant and stable temperature characteristics.

Because the channel plate 2 including the vibration plate 30 is not thick, the support substrate 5 is laminated at a side opposite the nozzle plate 1 of the channel plate 2 to secure the rigidity. Preferred materials for the support substrate 5 include, for improving the rigidity, various ceramics such as glass, silicon, $SiO_2$, $ZrO_2$, $Al_2O_3$.

In addition, the support substrate 5 includes the independently formed concave portion 51 for each individual liquid chamber 12 along the nozzle alignment direction and is preferably laminated at a position opposite a partition section between the individual liquid chambers 12. The channel 5*a* of the support substrate 5, if formed continuously along the nozzle alignment direction, serves as a part of the common liquid chamber 20.

Next, referring to FIGS. 3 and 7, the structure of the frame 102 of the liquid discharge head will be described.

Figure 3:
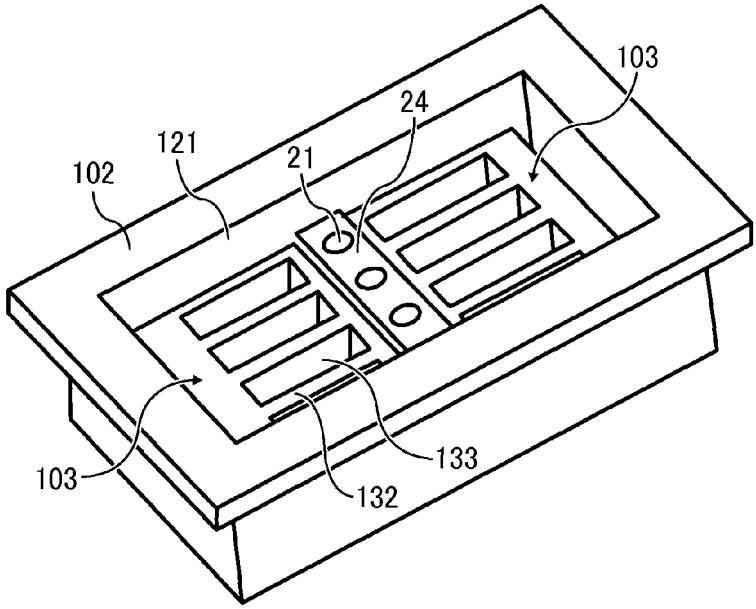
FIG. 3 is a perspective view of a frame including a damper member of the liquid discharge head.
Figure 4:
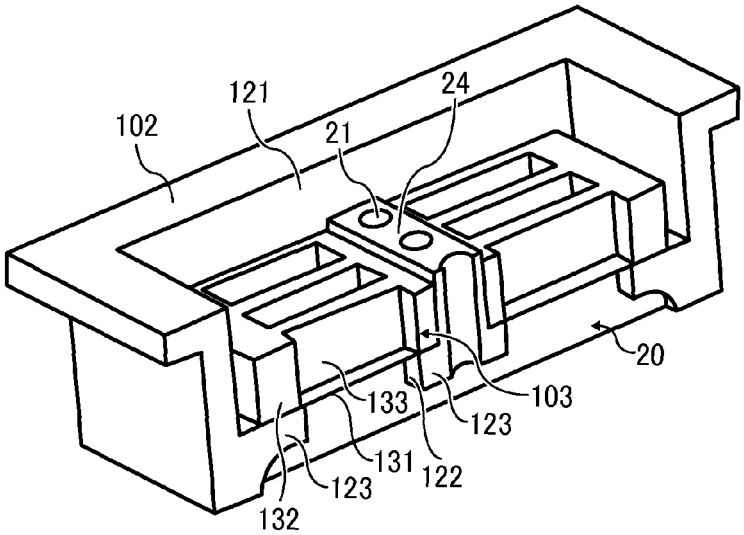
FIG. 4 is a cross-sectional view of the damper member along the nozzle alignment direction of FIG. 3.
Figure 5:
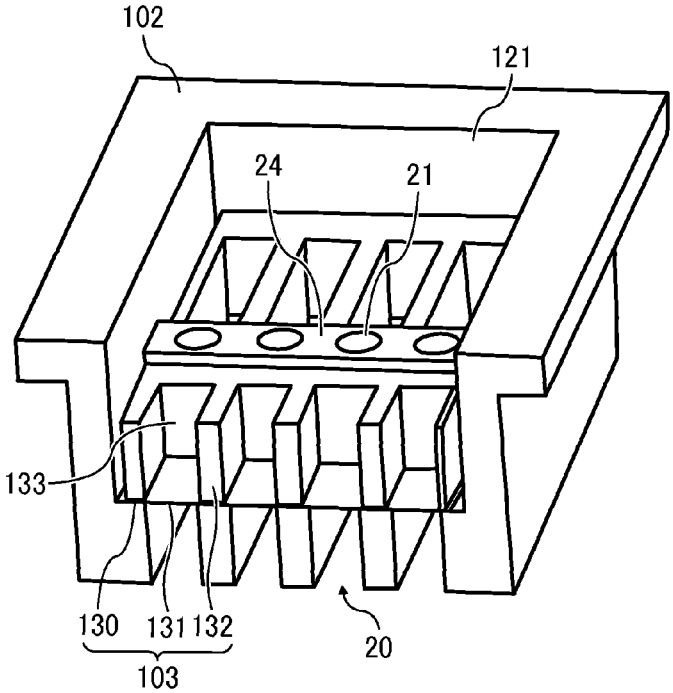
FIG. 5 is a cross-sectional view of the damper member along a direction perpendicular to the nozzle alignment direction of FIG. 3.
Figure 6:
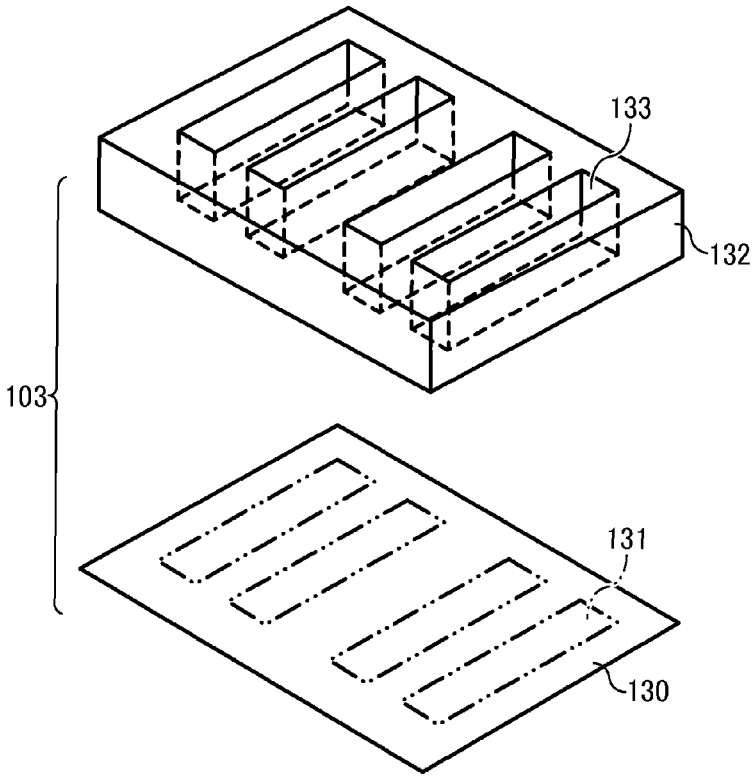
FIG. 6 is an exploded perspective view of the damper member.

Specifically, FIG. 3 is a perspective view of the frame including a damper member of the liquid discharge head; FIG. 4 is a cross-sectional view of the damper member along the nozzle alignment direction of FIG. 3; FIG. 5 is a cross-sectional view of the damper member along a direction perpendicular to the nozzle alignment direction of FIG. 3; FIG. 6 is an exploded perspective view of the damper member; and FIG. 7 is an enlarged cross-sectional view of the damper member and a supporter.

The frame 102 connects a surface opposite the surface that connects the nozzle plate 1 of the channel member 101, and forms the common liquid chamber 20 that supplies a liquid to the plurality of individual liquid chambers 12, to which the plurality of nozzles 11 that discharges liquid droplets communicate. The frame 102 includes a concave portion 120 serving as the common liquid chamber 20.

In addition, the frame 102 includes a concave portion 121 that forms a damper chamber 104 that accommodates a damper member 103.

Specifically, the frame 102 forms the common liquid chamber 20 and the damper chamber 104 disposed opposite the common liquid chamber 20 with a damper 131 in between. The damper 131 will be described later in detail.

The frame 102 includes a joint tube 24 that forms a part of the supply tubes to supply a liquid to the common liquid chamber 20 from outside. The joint tube 24 is disposed in the center of the concave portion 121 along the longitudinal direction of the common liquid chamber 20 and in the nozzle alignment direction. A liquid supply path 21 is formed inside the joint tube 24 (see FIGS. 3 and 4).

The damper member 103 is disposed in an area between the wall of the joint tube 24 of the frame 102 and the side wall of the concave portion 121, in the longitudinal direction of the common liquid chamber 20.

The damper member 103 includes a damper film 130 that serves to form a recoverably deformable damper 131 as a thin film member to form a wall opposite the individual liquid chamber of the common liquid chamber 20, and a holder member 132 laminated to the damper film 130 to hold the damper 131. The holder member 132 includes an opening 133 allowing the damper 131 to deform, as a part of the damper chamber 104.

Figure 7:
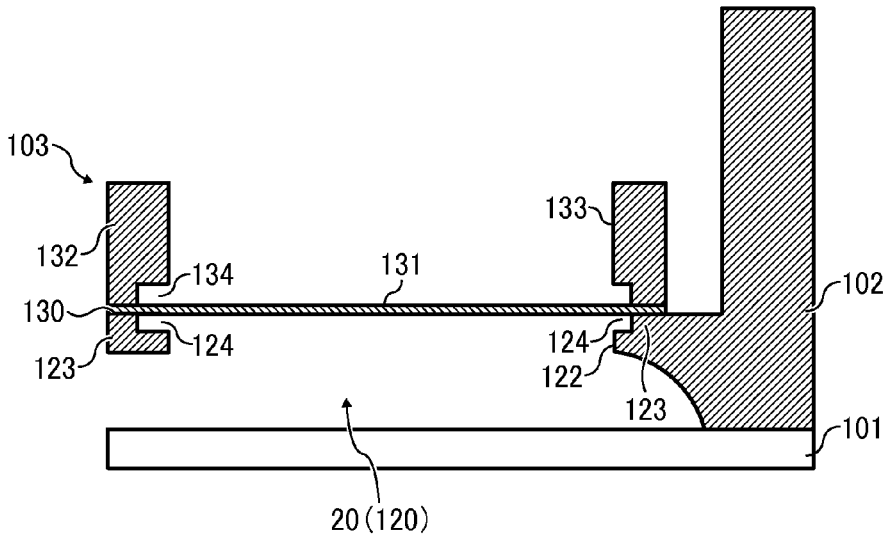
FIG. 7 is an enlarged cross-sectional view of the damper member and a supporter.

A relief groove 134 to escape an excessive adhesive is formed on the connection surface of the holder member 132 with the damper film 130 as illustrated in FIG. 7. As a result, an area of the damper 131 can be secured.

An opening 122 disposed opposite the damper 131 of the damper member 103 and a support member 123 to support the damper member 103 that forms a circumference of the opening 122 are formed in a bottom portion 121*a* of the common liquid chamber 20 of the concave portion 121 of the frame 102.

The damper member 103 is laminated to the wall of the side of the damper chamber 104 of the support member 123 of the frame 102 at a position where the damper 131 opposes the opening 122.

A wall of the support member 123 of the side of the damper chamber 104 forms a bottom part of the concave portion 121 of the frame 102.

A relief groove 124 to escape an excessive adhesive is formed on the connection surface of the support member 123 of the frame 102 with the damper member 103 as illustrated in FIG. 7. As a result, an area of the damper 131 can be secured.

As illustrated in FIG. 7, the common liquid chamber 20 is shaped to have a length that shortens toward an end in the head height direction, that is, a laminating direction of the frame 102 with the channel member 101.

Herein, the support member 123 at an end in the longitudinal direction of the common liquid chamber becomes thinner toward the opening 122. The support member 123 forms a wall of which the length shortens in the longitudinal end direction of the common liquid chamber 20.

On the other hand, a liquid supply member 105 is laminated to the side of the opening of the concave portion 121 of the frame 102.

The liquid supply member 105 includes a serpentine portion 151 (shown in FIG. 8), through which the damper chamber 104 is exposed to air. The liquid supply member 105 includes a joint tube 154 that forms a part of the supply tube in which the liquid supply path is formed.

The joint tube 24 of the frame 102 and the joint tube 154 of the liquid supply member 105 are connected via a packing 106.

That is, the packing 106 is disposed between the joint tube 24 of the frame 102 and the liquid supply member 105, and the support member 123 of the frame 102 disposed on the bottom of the common liquid chamber 20 is formed in a different area from the joint tube 24.

With this structure, the pressing force of attaching the packing 106 does not affect the damper member 103 directly, so that a reliability of the laminating strength between the damper member 103 and the support member 123 of the frame 102 can be secured.

Herein, each part will be briefly described.

The frame 102 supports the head as a whole, and is formed of iron such as S45C, alloys such as SUS, silicon, inorganic materials such as ceramics, and resins such as epoxy or polyphenylene sulfide (PPS).

The damper 131 can be formed of, for example, alloys such as SUS, metallic materials such as Ni, inorganic materials such as silicon and ceramics, and resin materials such as epoxy, PPS, thermoplastic elastomer, thermosetting elastomer, and silicon rubber.

The holder member 132 may be formed of, for example, alloys such as SUS and metallic materials such as Ni, inorganic materials such as silicon and ceramics, and resin materials such as epoxy and PPS. Resins that can be formed by projection molding are more preferable.

Configured as above, the frame 102 and the damper member 103 are laminated, the common liquid chamber 20 and the damper chamber 104 can be formed, and the damper 131 can be disposed between the common liquid chamber 20 and the damper chamber 104.

Specifically, the above structure is more simple than the previous method, in which a packing plate corresponding to the channel member or the pressure chamber substrate is laminated with a damper, so that a common liquid chamber is formed of which a part is the damper, and the packing plate is laminated with the housing member separately, so that an air chamber is formed on the backside of the damper (that is, on a surface opposite the common liquid chamber).

Figure 8:
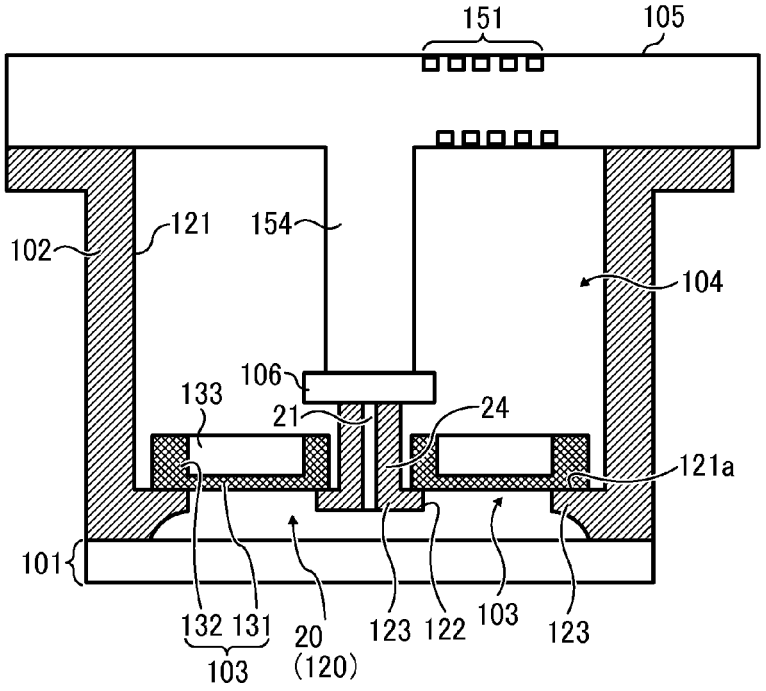
FIG. 8 is a cross-sectional view of the liquid discharge head along the nozzle alignment direction according to a second embodiment of the present invention.

Next, referring to FIG. 8, a liquid discharge head according to a second embodiment will be described. FIG. 8 is a cross-sectional view of the liquid discharge head along the nozzle alignment direction thereof.

The damper 131 and the holder member 132 of the damper member 103 are integrally formed in the second embodiment, which is different from the first embodiment.

Figure 9:
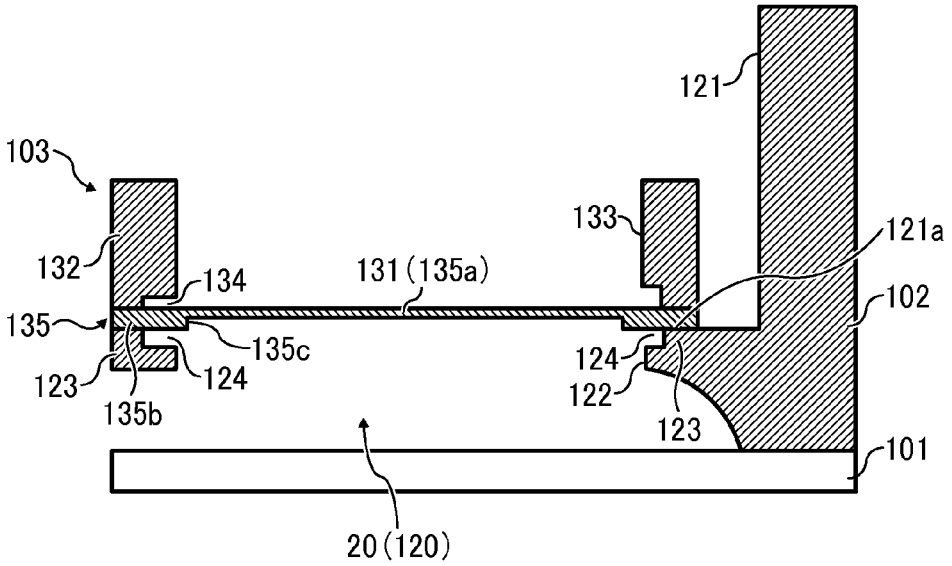
FIG. 9 is an enlarged cross-sectional view of the damper member and the supporter along the nozzle alignment direction of the liquid discharge head, according to a third embodiment of the present invention.

Next, referring to FIG. 9, a liquid discharge head according to a third embodiment will be described. FIG. 9 is an enlarged cross-sectional view of the damper member and the support member along the nozzle alignment direction of the liquid discharge head according to the third embodiment of the present invention.

The damper 131 is formed of a damper forming member 135 including a thin portion 135*a* used as the damper 131, and a thick portion 135*b* used as a laminated portion in the third embodiment.

The damper forming member 135 further includes a step portion 135*c* between the thin portion 135*a* and the thick portion 135*b*, and the damper forming member 135 is laminated to the damper member 103 so that the step portion 135*c* is disposed on the side of the common liquid chamber 20.

With this structure, the adhesive used for lamination forms a fillet, thereby reducing sticking out of the adhesive to the thin portion 135*a* serving as the damper 131 and securing an effective area of the damper 131.

Figure 10:
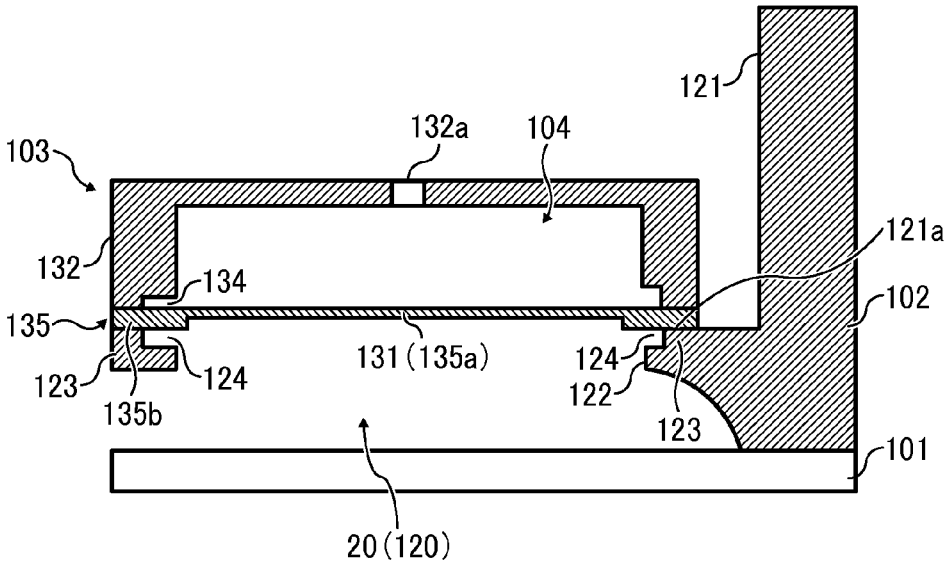
FIG. 10 is an enlarged cross-sectional view of the damper member and the supporter along the nozzle alignment direction of the liquid discharge head according to a fourth embodiment of the present invention.

Next, referring to FIG. 10, a liquid discharge head according to a fourth embodiment will be described. FIG. 10 is an enlarged cross-sectional view of the damper member and the support member along the nozzle alignment direction of the liquid discharge head according to the fourth embodiment of the present invention.

The damper chamber 104 is formed of the holder member 132 of the damper member 103 in the fourth embodiment. In this case, the concave portion 121 of the frame 102 serves as a part of the channel by which the damper chamber 104 is exposed to air.

Specifically, the space of the damper chamber 104 and the concave portion 121 communicate to each other via a through-hole 132*a* formed on the holder member 132.

When the damper 131 is formed of a resinous member through which moisture is permeable, the moisture inside the common liquid chamber 20 permeates the damper 131, and the liquid inside the common liquid chamber 20 may become more viscous.

However, because the damper chamber 104 according to the fourth embodiment has a volume smaller than that of the damper chamber 104 formed of the concave portion 121 of the frame 102 according to the second embodiment, water vapor pressure inside the damper chamber 104 tends to be high.

Therefore, the moisture can be prevented from permeating from the damper 131 to the damper chamber 104 compared to the structure according to the first embodiment.

Figure 11:
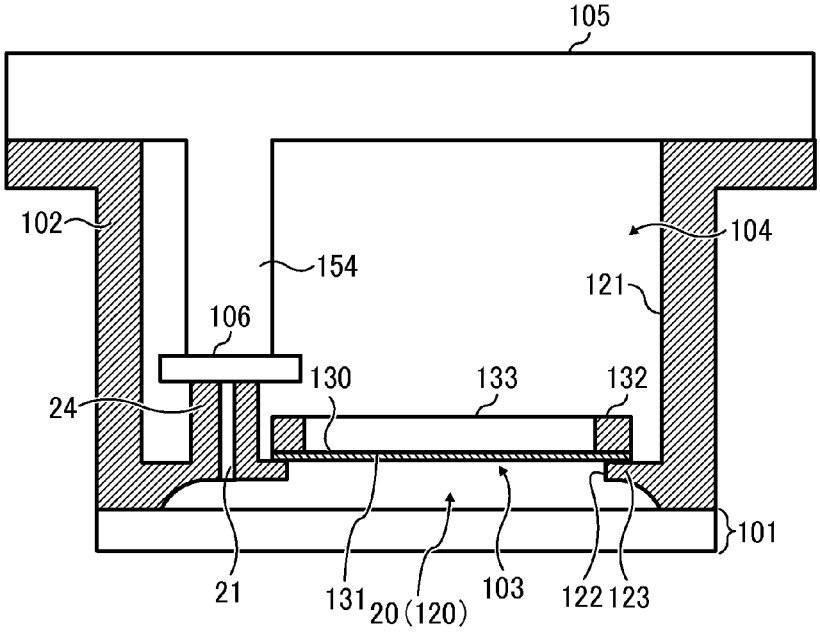
FIG. 11 is a cross-sectional view of the liquid discharge head along the nozzle alignment direction according to a fifth embodiment of the present invention.

Next, referring to FIG. 11, a liquid discharge head according to a fifth embodiment will be described. FIG. 11 is a cross-sectional view of the liquid discharge head along the nozzle alignment direction thereof.

The frame 102 includes a joint tube 24 that forms a part of the supply tubes to supply a liquid to the common liquid chamber 20 from outside. The joint tube 24 is disposed on an end of the concave portion 121 in the common liquid chamber longitudinal direction or the nozzle alignment direction. The liquid supply path 21 communicating to the common liquid chamber 20 is formed inside the joint tube 24 as described in the first embodiment.

Figure 12:
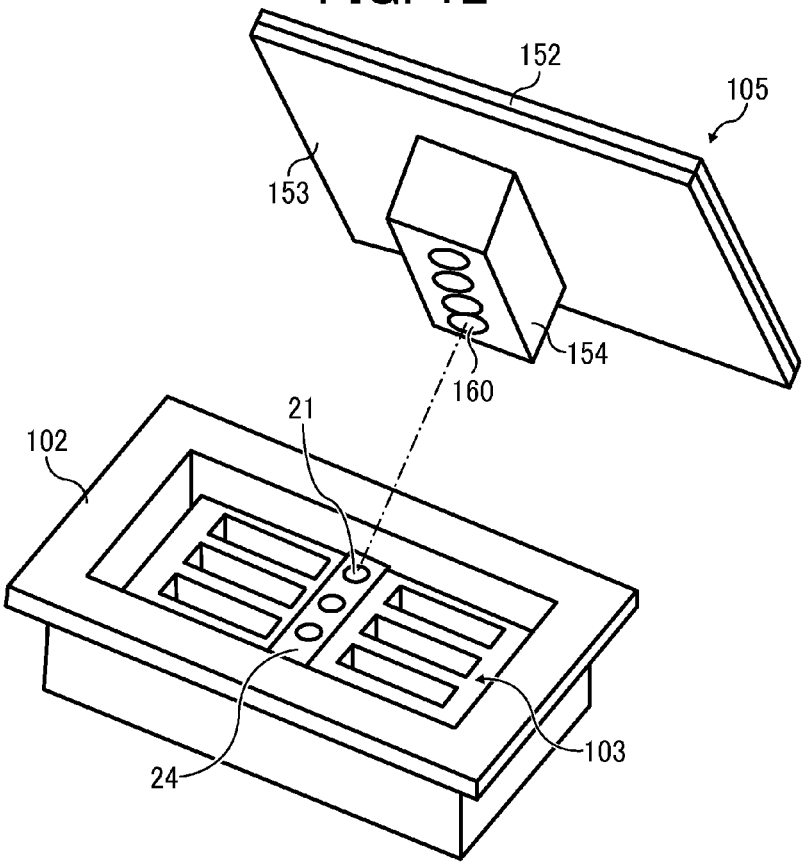
FIG. 12 is an exploded view of an exemplary liquid supply member and the frame.

Next, an exemplary liquid supply member according to the first embodiment will be described with reference to FIGS. 12 and 13. FIG. 12 is an exploded view of the liquid supply member and the frame; and FIG. 13 is an exploded view of the liquid supply member.

As described above, the liquid supply member 105 includes the joint tube 154 laminated to the concave portion 121 of the frame 102 on the side of the opening, and the joint tube 154 communicates with the joint tube 24 of the frame 102 via the packing 106. Herein, the serpentine portion 151 as illustrated in FIG. 1 is omitted for simplification.

Figure 13:
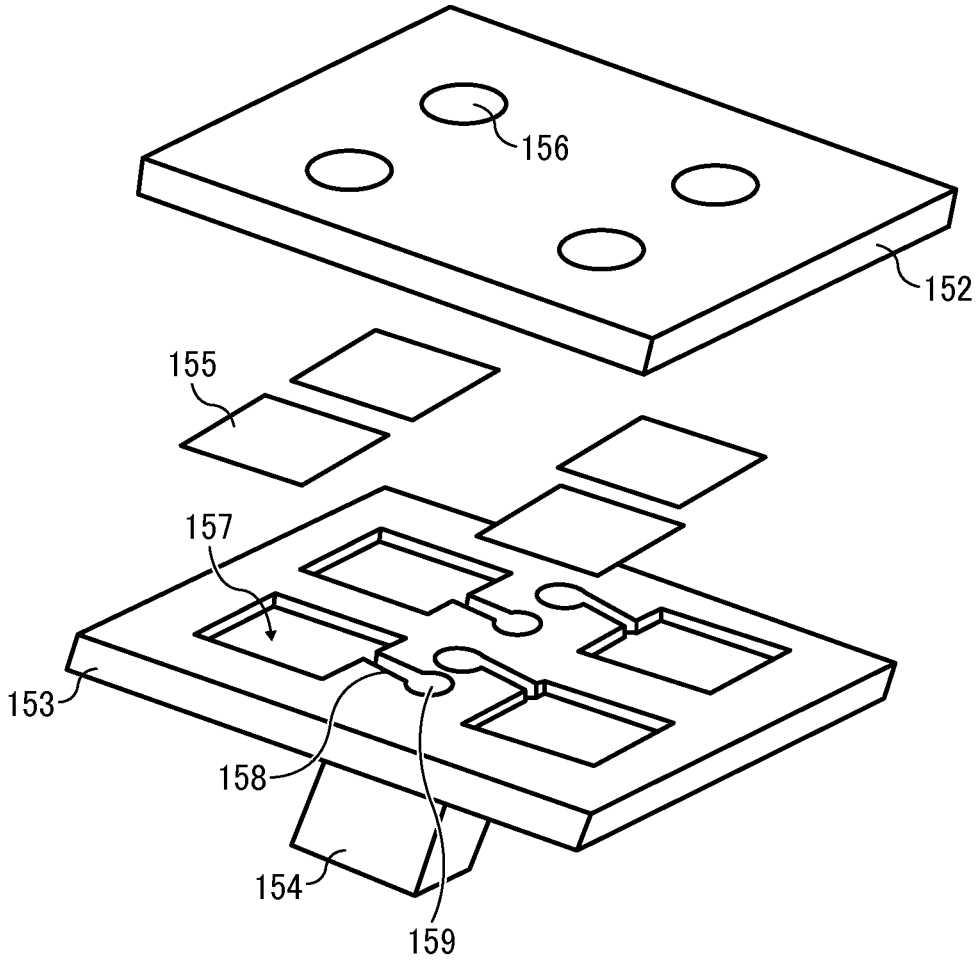
FIG. 13 is an exploded view of the liquid supply member.

As illustrated in FIGS. 12 and 13, the liquid supply member 105 includes an upper case 152, a lower case 153, and filters 155 sandwiched between the upper case 152 and the lower case 153, and is integrally disposed on the lower case 153 via the joint tube 154. Herein, the serpentine portion 151 as illustrated in FIG. 1 is omitted for simplification.

A plurality of supply ports 156 connecting to a liquid supply source such as a liquid tank is disposed on the upper case 152. A plurality of filter chambers 157 on each of which the filter 155 is disposed on the side of the supply ports 156, is disposed on the lower case 153, and each filter chamber 157 forms a supply port 159 of the liquid to the liquid discharge head via each fluid channel 158.

The supply port 159 is connected to a liquid supply path 21 of the joint tube 24 of the frame 102 via supply paths 160 disposed inside the joint tube 154.

According to the preferred embodiments of the present invention, a common liquid chamber and a damper chamber are formed with a simple structure, and a damper is formed between the common liquid chamber and the damper chamber.

Figure 14:
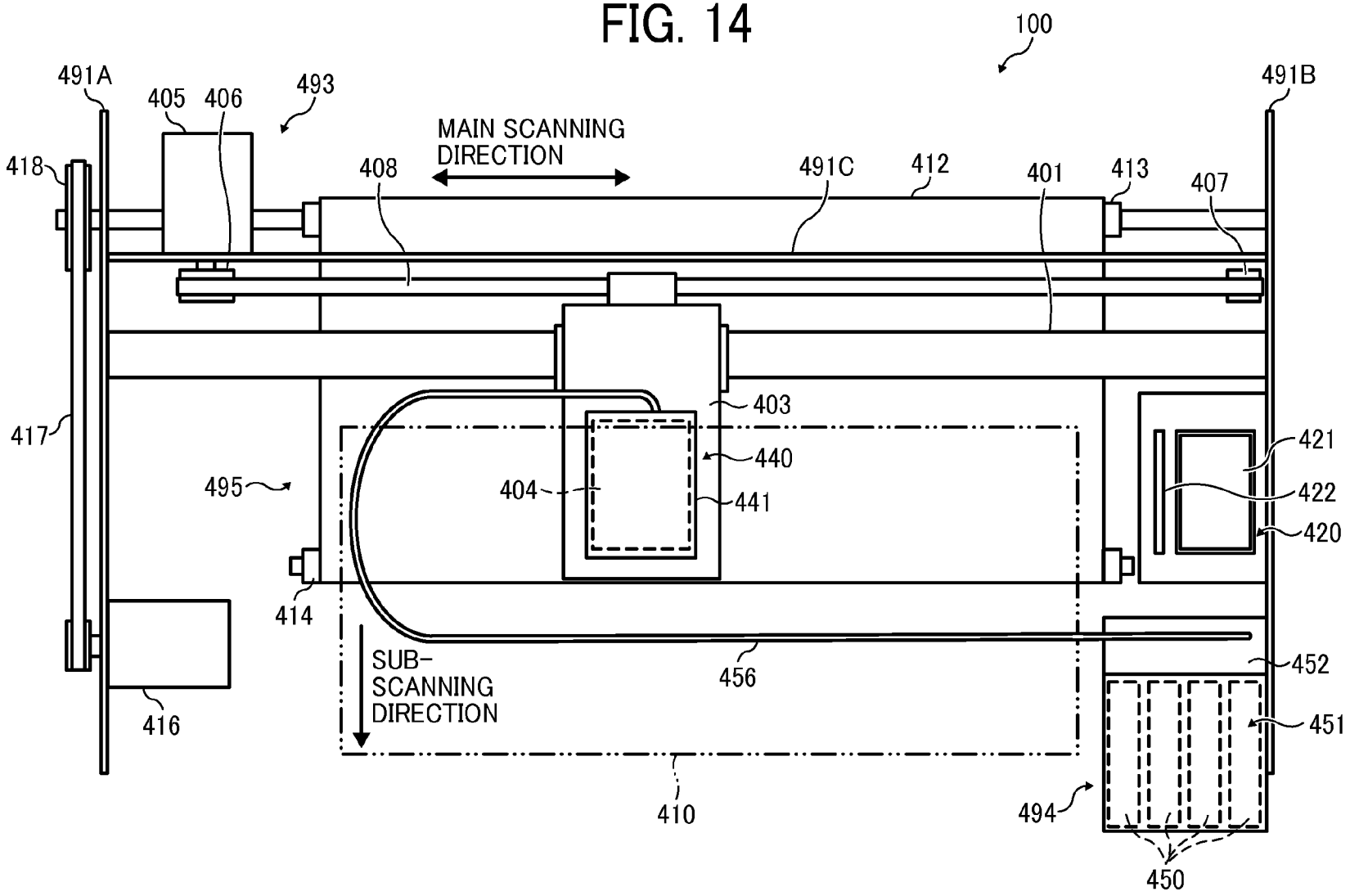
FIG. 14 is an exemplary liquid discharge apparatus illustrating a principle part thereof according to the embodiments of the present invention.
Figure 15:
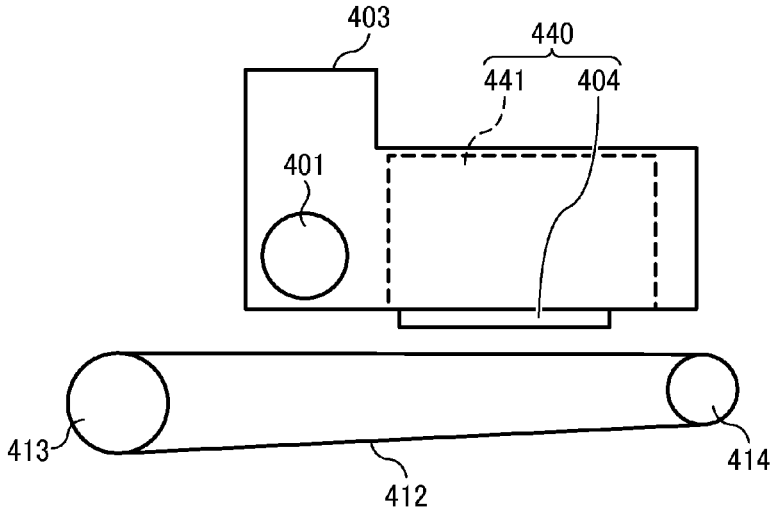
FIG. 15 schematically illustrates a side view of the liquid discharge apparatus of FIG. 14.

Next, an example of the liquid discharge apparatus according to the present invention will be described with reference to FIGS. 14 and 15. FIG. 14 is an explanatory plan view illustrating a principle part of the liquid discharge apparatus, and FIG. 15 is an explanatory side view of the same.

The present apparatus is a serial-type apparatus so that the carriage 403 reciprocally moves in the main scanning direction by a main scan moving unit 493. The main scan moving unit 493 includes a guide 401, a main scan motor 405, a timing belt 408, and the like. The guide 401 is held on right and left side plates 491A, 491B and supports the carriage 403 to be movable. The main scan motor 405 moves the carriage 403 reciprocally in a main scanning direction via a timing belt 408 stretched between a driving pulley 406 and a driven pulley 407.

A liquid discharge head 404 and a head tank 441 integrally form a liquid discharge device 440 that is mounted on the carriage 403. The liquid discharge head 404 of the liquid discharge device 440 discharges ink droplets of each color of yellow (Y), cyan (C), magenta (M), and black (K). The liquid discharge head 404 includes nozzle arrays formed of a plurality of nozzles 11 arranged in a sub-scanning direction perpendicular to the main scanning direction, with the discharging head oriented downward.

The liquid stored outside the liquid discharge head 404 is supplied to the liquid discharge head 404 via a supply unit 494 that supplies the liquid from a liquid cartridge 450 to the head tank 441.

The supply unit 494 includes a cartridge holder 451 to mount a liquid cartridge 450 thereon, a tube 456, and a liquid feed unit 452 including a feed pump. The liquid cartridge 450 is detachably attached to the cartridge holder 451. The liquid is supplied to the head tank 441 by the liquid feed unit 452 via the tube 456 from the liquid cartridge 450.

The present apparatus includes a conveying unit 495 to convey a sheet 410. The conveying unit 495 includes a conveyance belt 412, and a sub-scan motor 416 to drive the conveyance belt 412.

The conveyance belt 412 electrostatically attracts the sheet 410 and conveys it at a position facing the liquid discharge head 404. The conveyance belt 412 is an endless belt and is stretched between a conveyance roller 413 and a tension roller 414. The sheet 410 is attracted to the conveyance belt 412 due to an electrostatic force or by air aspiration.

The conveyance belt 412 is caused to rotate in the sub-scanning direction driven by a rotation of the conveyance roller 413 via a timing belt 417 and a timing pulley 418 driven by the sub-scan motor 416.

Further, a maintenance unit 420 to maintain the liquid discharge head 404 in good condition is disposed on the side of the conveyance belt 412 at one side in the main scanning direction of the carriage 403.

The maintenance unit 420 includes, for example, a cap member 421 to cap a nozzle face (i.e., a surface on which the nozzle is formed) of the liquid discharge head 404; a wiper 422 to clean the nozzle face, and the like.

The main scan moving unit 493, the supply unit 494, the maintenance unit 420, and the conveying unit 495 are disposed to a housing that includes side plates 491A, 491B, and a rear plate 491C.

In the thus-configured liquid discharge apparatus, a sheet 410 is conveyed on and attracted to the conveyance belt 412 and is conveyed in the sub-scanning direction by the cyclic rotation of the conveyance belt 412.

Then, the liquid discharge heads 404 are driven in response to image signals while the carriage 403 moving in the main scanning direction, and a liquid is discharged to the stopped sheet 410, thereby forming an image.

As a result, because the liquid discharge apparatus includes the liquid discharge head according to preferred embodiments of the present invention, a constantly high quality image is formed.

Figure 16:
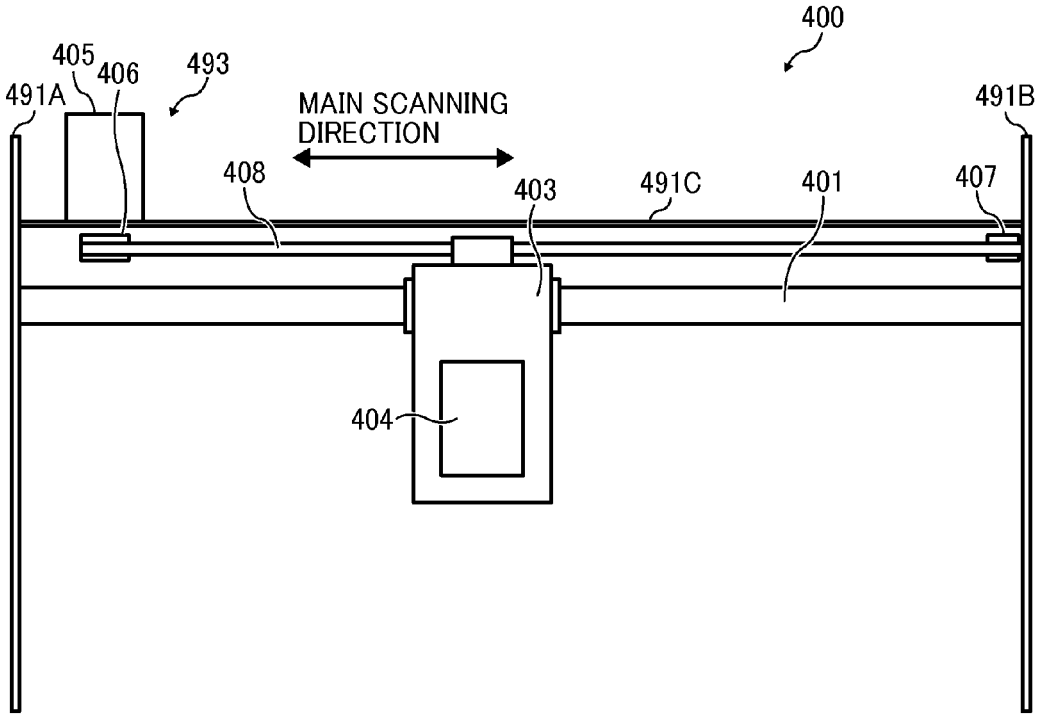
FIG. 16 is an example of a liquid discharge device illustrating a principle part thereof.

Next, another example of the liquid discharge device according to the present invention will be described with reference to FIG. 16. FIG. 16 is a plan view illustrating a principal part of the liquid discharge device 400.

The liquid discharge device 400 includes the side plates 491A, 491B and the rear plate 491C; the main scan moving unit 493; the carriage 403; and the liquid discharge head 404.

This liquid discharge device 400 further including at least one of the maintenance unit 420 disposed, for example, on the side plate 491B, and the supply unit 494, may also be configured as a liquid discharge device 400.

Figure 17:
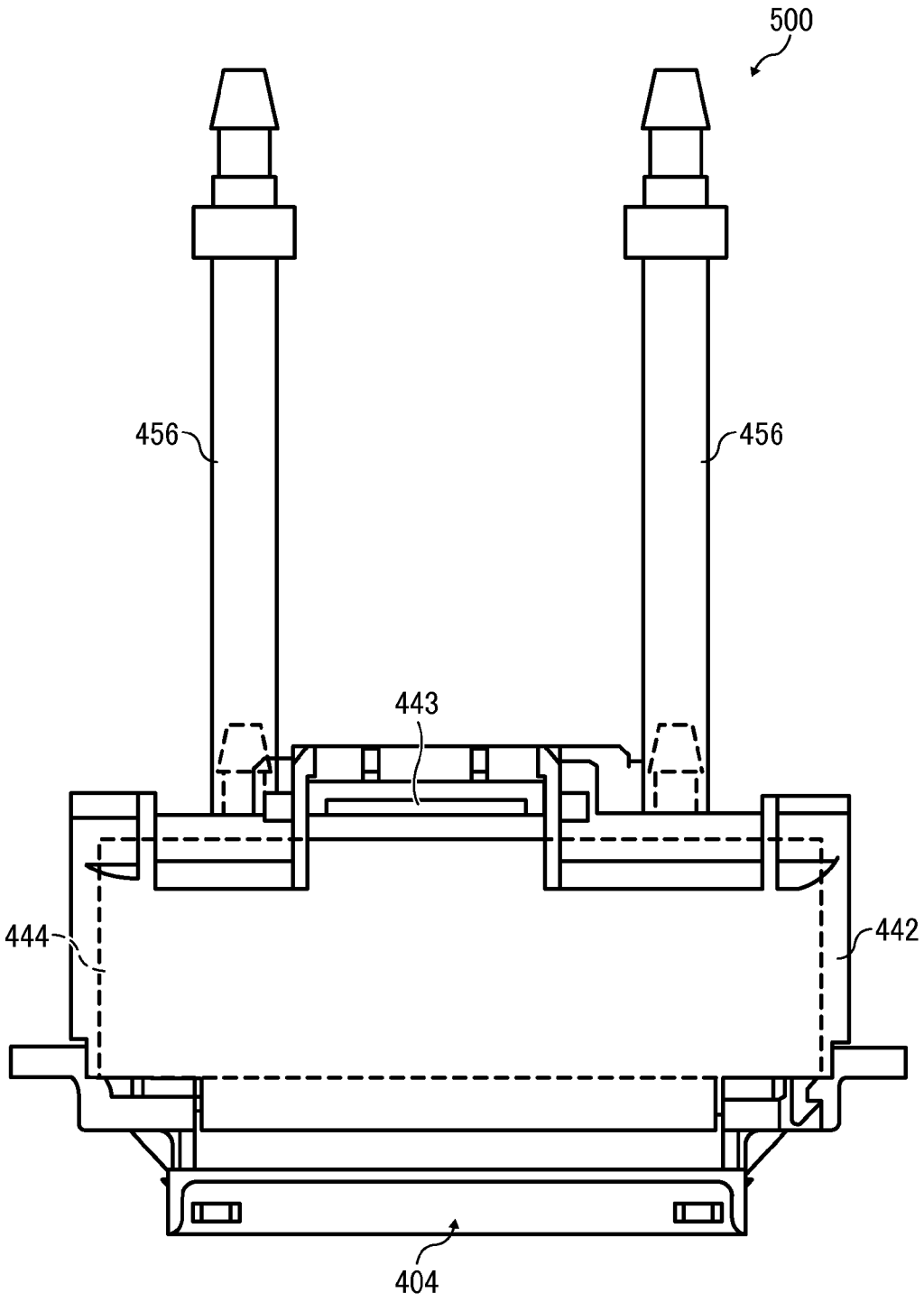
FIG. 17 is another example of a liquid discharge device including the liquid discharge head, a channel member, and tubes connected to the channel member according to the embodiment of the present invention.

Next, another liquid discharge device according to the present embodiment will be described with reference to FIG. 17. FIG. 17 is a front view illustrating a principal part of the liquid discharge device 500.

The present liquid discharge device 500 includes the liquid discharge head 404 to which a channel member 444 is attached, and the tube 456 connected to the channel member 444.

Further, the channel member 444 is disposed inside a cover 442. Instead of the channel member 444, the liquid discharge device 500 may include the head tank 441. A connector 443 disposed above the channel member 444 electrically connects the liquid discharge head 404 with a power source.

In the embodiments of the present invention, the liquid discharge apparatus includes a liquid discharge head or a liquid discharge device, and drives the liquid discharge head to discharge a liquid. As the liquid discharge apparatus, there are an apparatus capable of discharging a liquid to materials on which the liquid can be deposited as well as an apparatus to discharge the liquid toward a space or liquid.

The liquid discharge apparatus may include devices to feed, convey, and discharge the material on which the liquid can be deposited. The liquid discharge apparatus may further include a pretreatment apparatus to coat a treatment liquid onto the material, and a post treatment apparatus to coat the treatment liquid onto the material, onto which the liquid has been discharged.

Exemplary liquid discharge apparatuses may include, for example, an image forming apparatus to form an image on the sheet by discharging ink, and a three-dimensional apparatus to discharge a molding liquid to a powder layer in which powder material is formed in layers, so as to form a three-dimensional article.

In addition, the liquid discharge apparatus is not limited to such an apparatus to form and visualize images with letters or figures having meaning. Alternatively, the liquid discharge apparatus forms images without meaning such as patterns and three-dimensional objects.

The above materials on which the liquid can be deposited may include any material on which the liquid may be deposited even temporarily. Exemplary materials on which the liquid can be deposited may include paper, thread, fiber, fabric, leather, metals, plastics, glass, wood, ceramics, and the like, on which the liquid can be deposited even temporarily.

In addition, the liquid may include ink, a treatment liquid, DNA sample, resist, pattern material, binder, mold liquid, and the like.

Further, the exemplary liquid discharge apparatuses include, otherwise limited in particular, any of a serial-type apparatus to move the liquid discharge head and a line-type apparatus not to move the liquid discharge head.

The exemplary liquid discharge apparatuses include otherwise a treatment liquid coating apparatus to discharge the treatment liquid to the sheet to coat the treatment liquid on the surface of the sheet for the purpose of reforming a sheet surface, and an injection granulation apparatus in which a composition liquid including a raw materials dispersed in the solution is injected with the nozzle to granulate fine particles of the raw material.

The liquid discharge device is an integrated unit including the liquid discharge head and functional parts, or the liquid discharge head and other structures, and denotes an assembly of parts relative to the liquid discharge. For example, the liquid discharge device may be formed of a combination of the liquid discharge head with one of the head tank, carriage, supply unit, maintenance unit, and main scan moving unit.

Herein, examples of integrated unit include a liquid discharge head plus functional parts, of which structure is combined fixedly to each other through fastening, binding, and engaging, and ones movably held by the other parts. In addition, the liquid discharge head can be detachably attached to the functional parts or structures each other.

For example, an example of the liquid discharge device 440 as illustrated in FIG. 15 is integrally formed with the liquid discharge head and the head tank. Another example of the liquid discharge device is the integrally formed liquid discharge head and the head tank via the tube. A unit including a filter may further be added to a portion between the head tank and the liquid discharge head, thereby forming another liquid discharge device.

Further another example of the liquid discharge device is the liquid discharge head integrally formed with the carriage.

Still another example of the liquid discharge device includes the liquid discharge head movably held by the guide member that forms part of the main scan moving unit, so that the liquid discharge head and the main scan moving unit are integrally formed. Further, as illustrated in FIG. 16, the liquid discharge head, the carriage, and the main scan moving unit are integrally formed, thereby forming the liquid discharge device 400.

Furthermore, a cap member that forms part of the maintenance unit is fixed to the carriage on which the liquid discharge head is mounted, so that the liquid discharge head, the carriage, and the maintenance unit are integrally formed, thereby forming the liquid discharge device.

Further, the liquid discharge device 500 as illustrated in FIG. 17 includes the tube that is connected to the head tank or the channel member to which the liquid discharge head is attached, so that the liquid discharge head and the supply unit are integrally formed.

The main scan moving unit shall include a guide member itself The supply unit shall include a tube itself, and a cartridge holder itself The pressure generating unit of the liquid discharge head is not limited in particular. For example, other than the piezoelectric actuator (or a layered-type piezoelectric element) as described above, a thermal actuator that employs thermoelectric conversion elements such as a thermal resistor, and an electrostatic actuator formed of a vibration plate and an opposed electrode may be used.

The term "image formation" means not only recording, but also printing, image printing, molding, and the like.

Additional modifications and variations of the present invention are possible in light of the above teachings. It is therefore to be understood that, within the scope of the appended claims, the invention may be practiced other than as specifically described herein.

What is claimed is:

1. A liquid discharge head comprising:

a plurality of nozzles to discharge liquid droplets;

a plurality of individual liquid chambers to which the plurality of nozzles communicates;

a common liquid chamber, to supply a liquid to the plurality of individual liquid chambers, including a wall disposed opposite a side of an individual liquid chamber and formed of a deformable damper;

a frame forming the common liquid chamber and a damper chamber disposed opposite the common liquid chamber with the damper in between, wherein the damper chamber is a concave portion within a space bounded by the frame, and the concave portion accommodates a damper member including the damper.

2. The liquid discharge head as claimed in claim 1, wherein the damper member comprises a damper forming member to form the damper in a recoverably deformable manner to form the wall of the common liquid chamber, and a holder member to hold the damper forming member.

3. The liquid discharge head as claimed in claim I, wherein the frame comprises a joint tube disposed at a longitudinal center of the common liquid chamber and forming a part of a plurality of supply tubes to supply the liquid to the common liquid chamber from outside.

4. The liquid discharge head as claim in claim 1, wherein the frame comprises a joint tube disposed at one longitudinal end of the common liquid chamber and forming a part of a plurality of supply tubes to supply the liquid to the common liquid chamber from outside.

5. The liquid discharge head as claimed in claim 1, wherein the damper member comprises:

a damper forming member to form the damper in a recoverably deformable manner to form the wall of the common liquid chamber; and a holder member to hold the damper forming member and forming the damper chamber disposed opposite the common liquid chamber with the damper in between.

6. A liquid discharge device comprising the liquid discharge head as claimed in claim 1.

7. The liquid discharge device as claimed in claim 6, wherein the liquid discharge head is integrally formed with at least one of a head tank to store a liquid to be supplied to the liquid discharge head, a carriage to mount the liquid discharge head thereon, a supply unit to supply the liquid to the liquid discharge head, a maintenance unit to maintain the liquid discharge head, and a main scan moving unit to move the liquid discharge head in a main scanning direction.

8. A liquid discharge apparatus comprising the liquid discharge device as claimed in claim 6.

9. A liquid discharge apparatus comprising the liquid discharge head as claimed in claim 1.

10. The liquid discharge head as claimed in claim 1, further comprising:

a channel member coupled to a common liquid chamber side of the frame, wherein the channel member includes a nozzle plate on which the nozzles are formed, a channel plate on which the individual liquid chamber communicating with a corresponding nozzle is formed, and a support substrate coupled to the frame and on which a channel connected with the common liquid chamber and communicating with the individual liquid chamber is formed, and wherein the support substrate constitutes the wall of the common liquid chamber.

11. The liquid discharge head as claimed in claim 1, further comprising:

a liquid supply member in which a liquid supply path is formed to supply liquid to the common liquid chamber, the liquid supply member being coupled to the frame at an opening side of the concave portion of the frame, wherein the damper member is accommodated in a space constituted of the liquid supply member and the concave portion of the frame.

12. The liquid discharge head as claimed in claim 3, wherein the joint tube is a protrusion protruding toward the damper chamber of the frame, and the liquid supply path is formed in the protrusion to communicate with the common liquid chamber.

13. The liquid discharge head as claimed in claim 2, wherein the holder member includes an opening to permit deformation of the damper, and the opening communicates with a space of the concave portion and constitutes a part of the damper chamber.

14. The liquid discharge head as claimed in claim 2, wherein the damper member further comprises a relief groove bounded by the damper forming member and the holder member.

15. The liquid discharge head as claimed in claim 1, wherein an opening is disposed at a lower portion of the concave portion of the frame and the damper is disposed to face the opening, and the frame further comprises a support member forming a circumference of the opening, to support the damper member.

16. The liquid discharge head as claimed in claim 15, further comprises a relief groove bounded by the damper member and the support member of the frame.

17. A liquid discharge head comprising:

a plurality of nozzles to discharge liquid droplets;

a plurality of individual liquid chambers to which the plurality of nozzles communicates;

a common liquid chamber, to supply a liquid to the plurality of individual liquid chambers, including a wall disposed opposite a side of an individual liquid chamber and formed of a deformable damper;

a frame forming the common liquid chamber and a damper chamber disposed opposite the common liquid chamber with the damper in between, wherein the frame accommodates a damper member including the damper and includes a concave portion that serves as the damper chamber;

an opening opposite the damper and a support member to support the damper member, the opening and the support member disposed on a bottom of the concave portion facing the common liquid chamber: and a damper forming member including a thin portion used as the damper, a thick portion laminated to the support member of the frame, and a step portion between the thin portion and the thick portion, wherein the damper forming member is laminated to the support member of the frame with the step portion disposed on a side of the common liquid chamber.

18. A liquid discharge device comprising the liquid discharge head as claimed in claim 17.

19. A liquid discharge apparatus comprising the liquid discharge device as claimed in claim 18.

20. A liquid discharge apparatus comprising the liquid discharge head as claimed in claim 17.

* * * * *